US011448154B2

(12) United States Patent
Suganuma et al.

(10) Patent No.: US 11,448,154 B2
(45) Date of Patent: Sep. 20, 2022

(54) INJECTION CONTROL DEVICE

(71) Applicant: DENSO CORPORATION, Kariya (JP)

(72) Inventors: Yohei Suganuma, Kariya (JP); Masashi Inaba, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/330,764

(22) Filed: May 26, 2021

(65) Prior Publication Data

US 2021/0372340 A1 Dec. 2, 2021

(30) Foreign Application Priority Data

May 28, 2020 (JP) ..... JP2020-093307

(51) Int. Cl.

| | |
|---|---|
| ***F02D 41/20*** | (2006.01) |
| ***F02D 41/22*** | (2006.01) |
| ***F02D 41/14*** | (2006.01) |
| ***F02D 41/26*** | (2006.01) |
| ***F02D 41/38*** | (2006.01) |

(52) U.S. Cl.

CPC ..... *F02D 41/221* (2013.01); *F02D 41/1454* (2013.01); *F02D 41/20* (2013.01); *F02D 41/26* (2013.01); *F02D 41/38* (2013.01); *F02D 2041/2013* (2013.01); *F02D 2041/2027* (2013.01); *F02D 2041/2034* (2013.01); *F02D 2041/2041* (2013.01); *F02D 2041/2062* (2013.01); *F02D 2041/224* (2013.01)

(58) Field of Classification Search

CPC .... F02D 41/1454; F02D 41/20; F02D 41/221; F02D 41/26; F02D 41/38; F02D 2041/2003; F02D 2041/2013; F02D 2041/2027; F02D 2041/2034; F02D 2041/2041; F02D 2041/2058

USPC ..... 701/104; 123/480, 488, 490

See application file for complete search history.

(56) References Cited

U.S. PATENT DOCUMENTS

| | | | | |
|---|---|---|---|---|
| 10,280,864 | B2 * | 5/2019 | Yanoto | F02D 41/401 |
| 2002/0189593 | A1 * | 12/2002 | Yamakado | F02D 41/20 123/490 |
| 2015/0114099 | A1 * | 4/2015 | Qiao | F02D 41/20 73/114.49 |
| 2015/0144109 | A1 * | 5/2015 | Mukaihara | F02D 41/36 123/490 |
| 2016/0319763 | A1 * | 11/2016 | Shen | F02D 41/20 |
| 2017/0009697 | A1 * | 1/2017 | Anetsberger | F02M 63/023 |
| 2020/0284214 | A1 | 9/2020 | Inaba et al. | |

FOREIGN PATENT DOCUMENTS

| | | |
|---|---|---|
| JP | 2010-138918 A | 6/2010 |
| JP | 2016-033343 A | 3/2016 |

* cited by examiner

*Primary Examiner* — Erick R Solis

(74) *Attorney, Agent, or Firm* — Posz Law Group, PLC

(57) ABSTRACT

An injection control device of capable of correcting an energization time even in an S/N non-guaranteeable situation includes: an energization controller calculating an energization time correction amount based on an area correction performed by an energization time correction amount calculator regarding electric current flowing in a fuel injection valve when the fuel injection valve is electrically driven for injecting fuel; and an energization instruction time calculator correcting an energization instruction time for fuel injection in a next cycle and thereafter by using the energization instruction time correction amounts in or before a current cycle.

4 Claims, 6 Drawing Sheets

INJECTION CONTROL DEVICE

CROSS REFERENCE TO RELATED APPLICATION

The present application is based on and claims the benefit of priority of Japanese Patent Application No. 2020-093307, filed on May 28, 2020, the disclosure of which is incorporated herein by reference.

TECHNICAL FIELD

The present disclosure generally relates to an injection control device that controls valve opening/closing of a fuel injection valve.

BACKGROUND INFORMATION

The injection control device is used to inject fuel into an internal combustion engine by opening and closing a fuel injection valve. The injection control device controls valve opening by energizing an electrically driveable fuel injection valve with an electric current. In recent years, an ideal current profile of an energizing current based on an instruction injection amount has been defined, and an injection control device controls valve opening by applying an electric current to a fuel injection valve based on the ideal current profile.

SUMMARY

It is an object of the present disclosure to provide an injection control device capable of calculating the energization time correction amount as appropriately as possible even when an S/N of the detected current cannot be secured.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Figure 1:
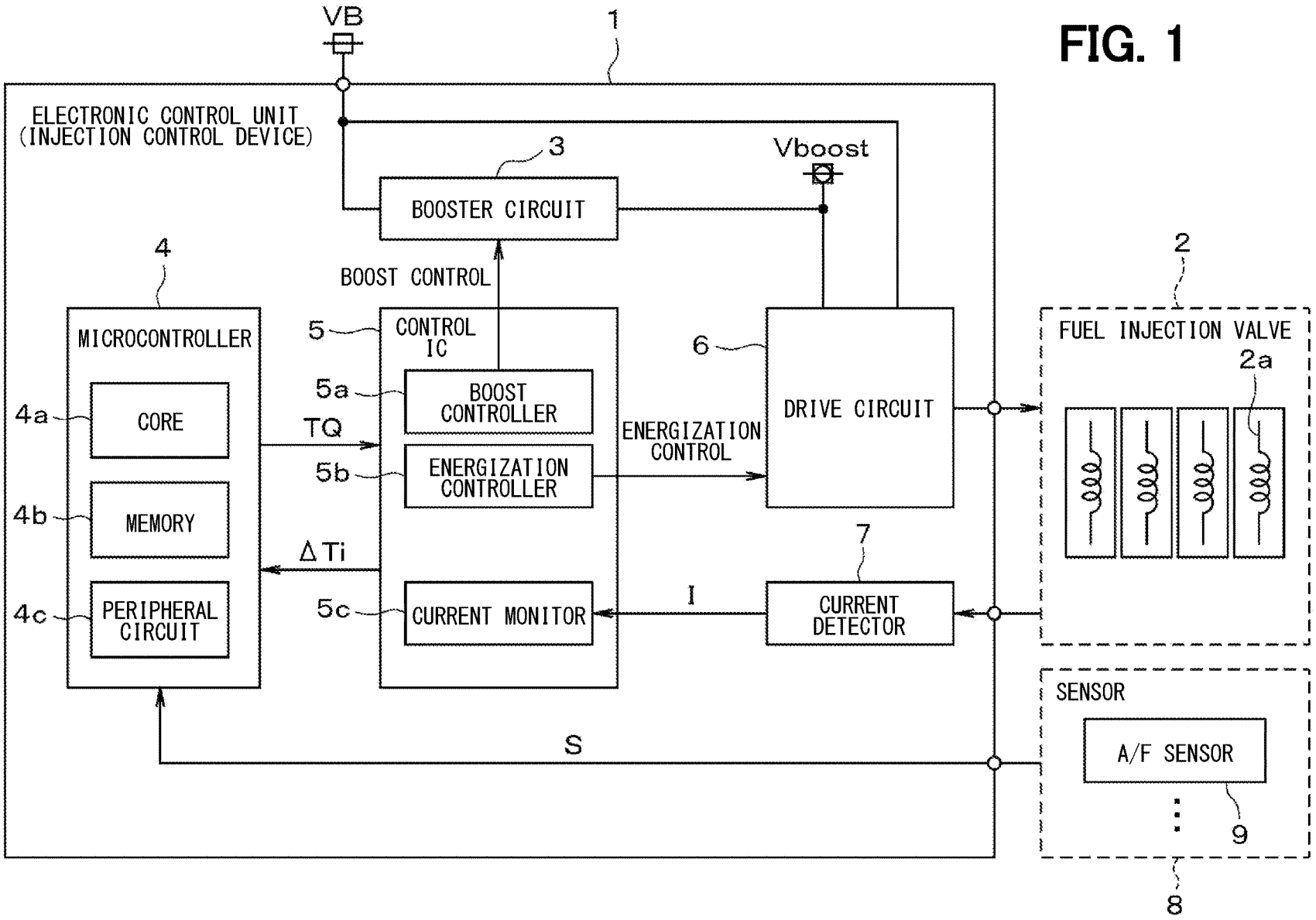
FIG. 1 is an electrical configuration diagram of an injection control device according to an embodiment.

Embodiments of the present disclosure are described based on the drawings. Hereinafter, the embodiments of the present disclosure are described with reference to the attached drawings. As shown in FIG. 1, an electronic control unit 1 (ECU) is configured as an injection control device that drives and controls a solenoid-type fuel injection valve 2 (also called an injector) which injects and supplies fuel directly to an internal combustion engine mounted on a vehicle such as an automobile. Hereinafter, an example of such device applied as the electronic control unit 1 for controlling a gasoline engine will be described, but it may also be applied to an electronic control device for controlling a diesel engine.

Although the fuel injection valve 2 for four cylinders is shown in FIG. 1, it is also applicable to two cylinders, three cylinders, six cylinders, and eight cylinders. The fuel injection valve 2 includes a needle-shaped valve body, and fuel can be injected by moving the valve body by energizing a solenoid coil 2*a*.

The electronic control unit 1 includes an electrical configuration as a booster circuit 3, a microcontroller 4, a control IC 5, a drive circuit 6, and a current detector 7. The microcontroller 4 is configured to include one or more cores 4*a* (including a processor), a memory 4*b* such as ROM and RAM, and a peripheral circuit 4*c* such as an A/D converter, and performs various controls based on a program stored in the memory 4*b* and a sensor signal S obtained from various sensors 8.

For example, the sensor 8 for a gasoline engine includes a crank angle sensor that outputs a pulse signal each time a crank shaft rotates by a preset angle, a water temperature sensor that is arranged in a cylinder block of an internal combustion engine to detect a cooling water temperature, an intake amount sensor that detects an air intake amount, a fuel pressure sensor that detects a fuel pressure at the time of fuel injection into the internal combustion engine, an A/F sensor 9 that detects the air-fuel ratio of the internal combustion engine, that is, an A/F value, and the like. FIG. 1 shows the sensor 8 in a simplified manner.

The microcontroller 4 calculates an engine speed (i.e., engine rotation number) from a pulse signal of the crank angle sensor, and obtains an accelerator opening degree from an accelerator signal of an accelerator sensor. The microcontroller 4 estimates temperature of the fuel injection valve 2 from the cooling water temperature of the water temperature sensor, while calculating a target torque required for the internal combustion engine based on the accelerator opening degree, a hydraulic pressure, and the A/F value, and calculates a required injection amount, which serves as a target, based on the target torque.

Further, the microcontroller 4 calculates an energization instruction time Ti of an instruction TQ (for opening the injection valve) based on the required injection amount as a target and the fuel pressure detected by the fuel pressure sensor. Therefore, the microcontroller 4 calculates the injection instruction timing for each cylinder based on the sensor signal S input from the various sensors 8 described above, and outputs the fuel instruction TQ to the control IC 5 at such injection instruction timing.

Note that the microcontroller 4 can calculate an injection start time in each cylinder based on the engine speed calculated by the pulse signal of the crank angle sensor. Further, the microcontroller 4 includes an internal timer inside the peripheral circuit 4*c*, and the internal timer can calculate an inter-cylinder injection interval, i.e., an interval from an injection end time of a first cylinder to an injection start time of a second cylinder when injection into the second cylinder comes immediately after injection into the first cylinder, that is, an interval of serial injections.

The control IC 5 is, for example, an integrated circuit device using an ASIC, and includes, for example, a control entity made up by a logic circuit, a CPU and the like, a storage unit such as a RAM, a ROM, or an EEPROM, and a comparator using a comparator circuit (none of which is shown), and is configured to perform various controls based on hardware and software. The control IC 5 has functions as a boost controller 5*a*, an energization controller 5*b*, and a current monitor 5*c*.

The booster circuit 3 receives an input of a battery voltage VB to boost the input voltage. The boost controller 5*a* boost-controls the battery voltage VB input to the booster circuit 3 and supplies a boost voltage Vboost from the booster circuit 3 to the drive circuit 6.

The drive circuit 6 is configured to receive an input of a battery voltage VB and a boost voltage V boost, and, by an application of a voltage (i.e., the boost voltage Vboost or the battery voltage VB) to the solenoid coil 2*a* of the fuel injection valve 2 of each cylinder due to an energization control of the energization controller 5*b* of the control IC 5, the drive circuit 6 drives the fuel injection valve 2 to inject fuel. For example, the boost voltage Vboost may be used for a first boost phase, and then the lower battery voltage VB may be used for a constant current phase (not shown).

The current detector 7 is composed of a current detection resistor. The current monitor 5*c* of the control IC 5 is configured by using, for example, a comparison unit using a comparator, an A/D converter and the like (neither shown), and monitors the electric current flowing through the solenoid coil 2*a* of the fuel injection valve 2 via the current detector 7.

Figure 2:
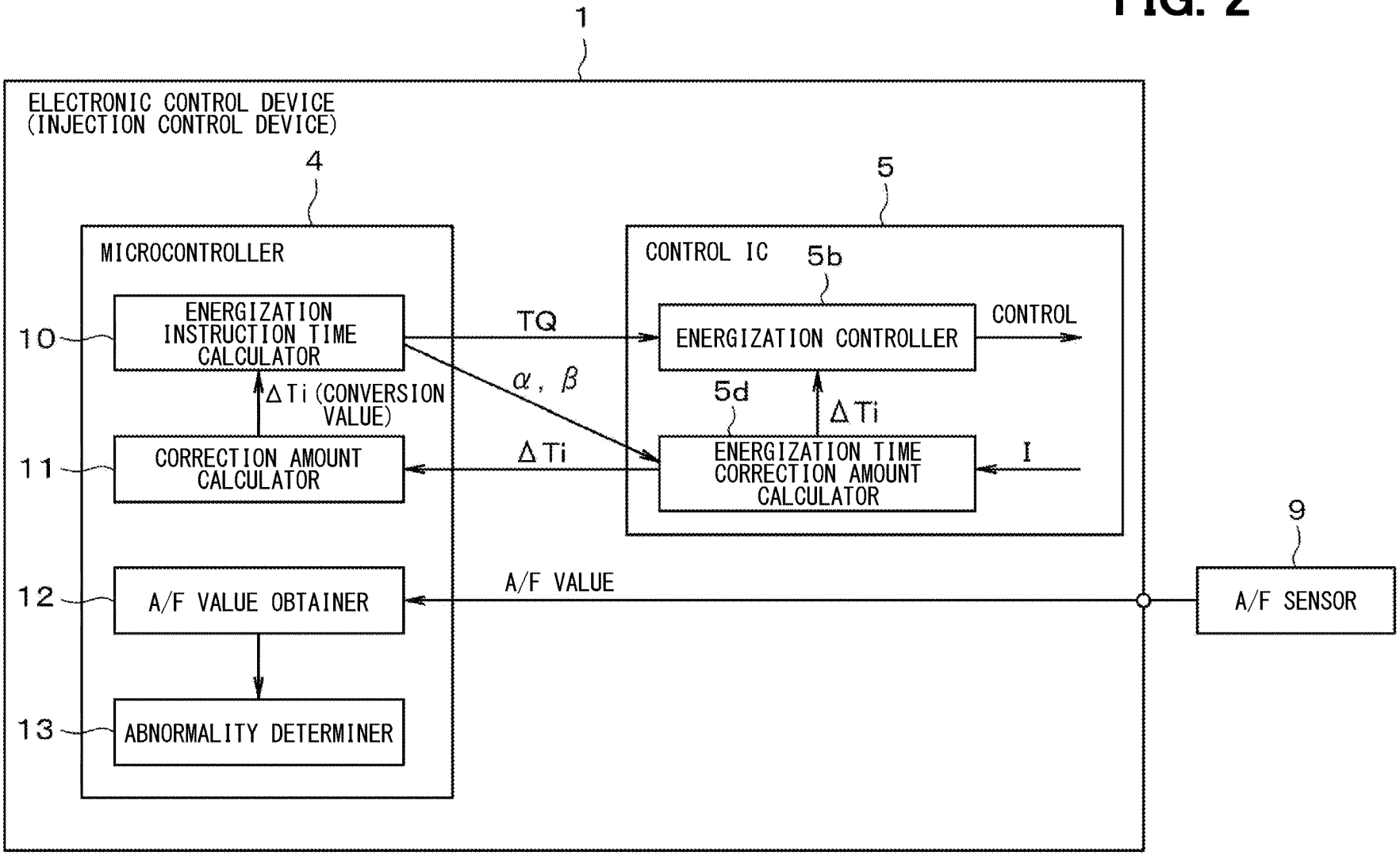
FIG. 2 is an explanatory diagram of information communicated between a microcontroller and a control IC.

Further, FIG. 2 schematically shows the functional configurations of the microcontroller 4 and the control IC 5. The microcontroller 4 operates as an energization instruction time calculator 10, a correction amount calculator 11, an A/F value obtainer 12 and an abnormality determiner 13 by executing a program stored in the memory 4*b* by the core 4*a*. The control IC 5 also has functions of the boost controller 5*a*, of the energization controller 5*b*, and of the current monitor 5*c* described above, as well as a function of an energization time correction amount calculator 5*d* serving as an area corrector.

The energization instruction time calculator 10 calculates the required injection amount at the start of injection control based on the sensor signal S of various sensors 8, and calculates the energization instruction time Ti of the instruction TQ and correction coefficients α and β. The energization instruction time Ti of the instruction TQ indicates the time/duration for instructing the fuel injection valve 2 to apply (i.e., to operate by) a voltage (for example, the boost voltage Vboost) during injection control. The correction coefficient α is a coefficient used for estimating a current difference between a normal current profile PI, which is a target electric current to flow through the fuel injection valve 2, and an actual energization current EI, and it is a coefficient calculated by using load characteristics of the fuel injection valve 2 and the like. The correction coefficient β is a coefficient used for estimating a peak current estimated value Ipa1 of the injection control, and is a coefficient calculated based on the load characteristics of the fuel injection valve 2 and the like. The energization controller 5*b* of the control IC 5 inputs (i.e., receives an input of) the energization instruction time Ti of the instruction TQ, and the energization time correction amount calculator 5*d* of the control IC 5 inputs (i.e., receives an input of) the correction coefficients α and β.

When the energization instruction time Ti of the instruction TQ is input, the energization controller 5*b* of the control IC 5 energizes and controls the voltage applied to the fuel injection valve 2 through the drive circuit 6. On the other hand, when the fuel injection valve 2 is electrically driven by the energization controller 5*b*, i.e., by receiving electric current, to inject fuel from the fuel injection valve 2, the energization time correction amount calculator 5*d* of the control IC 5 obtains a present electric current I flowing through the fuel injection valve 2 for performing the area correction of the electric current is performed to calculate an energization time correction amount ΔTi.

When the energization time correction amount calculator 5*d* calculates the energization time correction amount ΔTi, it is fed back to the energization controller 5*b*. The energization controller 5*b* performs energization control of the fuel injection valve 2 by using the energization instruction time Ti of the instruction TQ, by reflecting the energization time correction amount ΔTi in real time to the energization instruction time Ti of the instruction TQ that is input correspondingly to each of the injection controls (i.e., in response to each of multiple injections of fuel into different cylinders).

On the other hand, the correction amount calculator 11 of the microcontroller 4 inputs (i.e., receives an input of) the energization time correction amount ΔTi from the energization time correction amount calculator 5*d* of the control IC 5. The correction amount calculator 11 calculates an average of the energization time correction amounts ΔTi in current cycle and in previous cycles, and outputs the averaged energization time correction amount ΔTi to the energization instruction time calculator 10.

The energization instruction time calculator 10 calculates the required injection amount at the start of the next injection control based on the sensor signal S of the various sensors 8, and repeatedly performs the above-described injection control by calculating (i) the instruction TQ reflecting the averaged energization time correction amount ΔTi, and (ii) the correction coefficients α and β. Thus, in other words, the energization instruction time calculator 10 repeats the injection control, by calculating the energization instruction time Ti of the next injection by using the energization time correction amount ΔTi of the injection in the current cycle and in the previous cycles.

Further, the microcontroller 4 obtains the A/F value from the A/F sensor 9 by the A/F value obtainer 12. The microcontroller 4 obtains the A/F value by the A/F value obtainer 12 asynchronously with the injection instruction timing described above. The abnormality determiner 13 obtains, from the A/F value obtainer 12, the A/F value corresponding to the injection (i.e., injection control) reflecting the correction of the energization time correction amount ΔTi by the energization instruction time calculator 10, and determines abnormality (specifically, an A/F abnormality) based on a difference/shift/deviation of the obtained A/F value from the target A/F value.

Hereinafter, the operation of partial lift injection from the fuel injection valve 2 is described. In the partial lift injection, the injection process of closing the fuel injection valve 2 is executed before the valve is completely opened.

When the battery voltage VB is applied to the electronic control unit 1, the microcontroller 4 and the control IC 5 are activated. The boost controller 5*a* of the control IC 5 boosts an output voltage of the booster circuit 3 by outputting a boost control pulse to the booster circuit 3. The boost voltage Vboost is charged up to a preset boost completion voltage exceeding the battery voltage VB.

Figure 3:
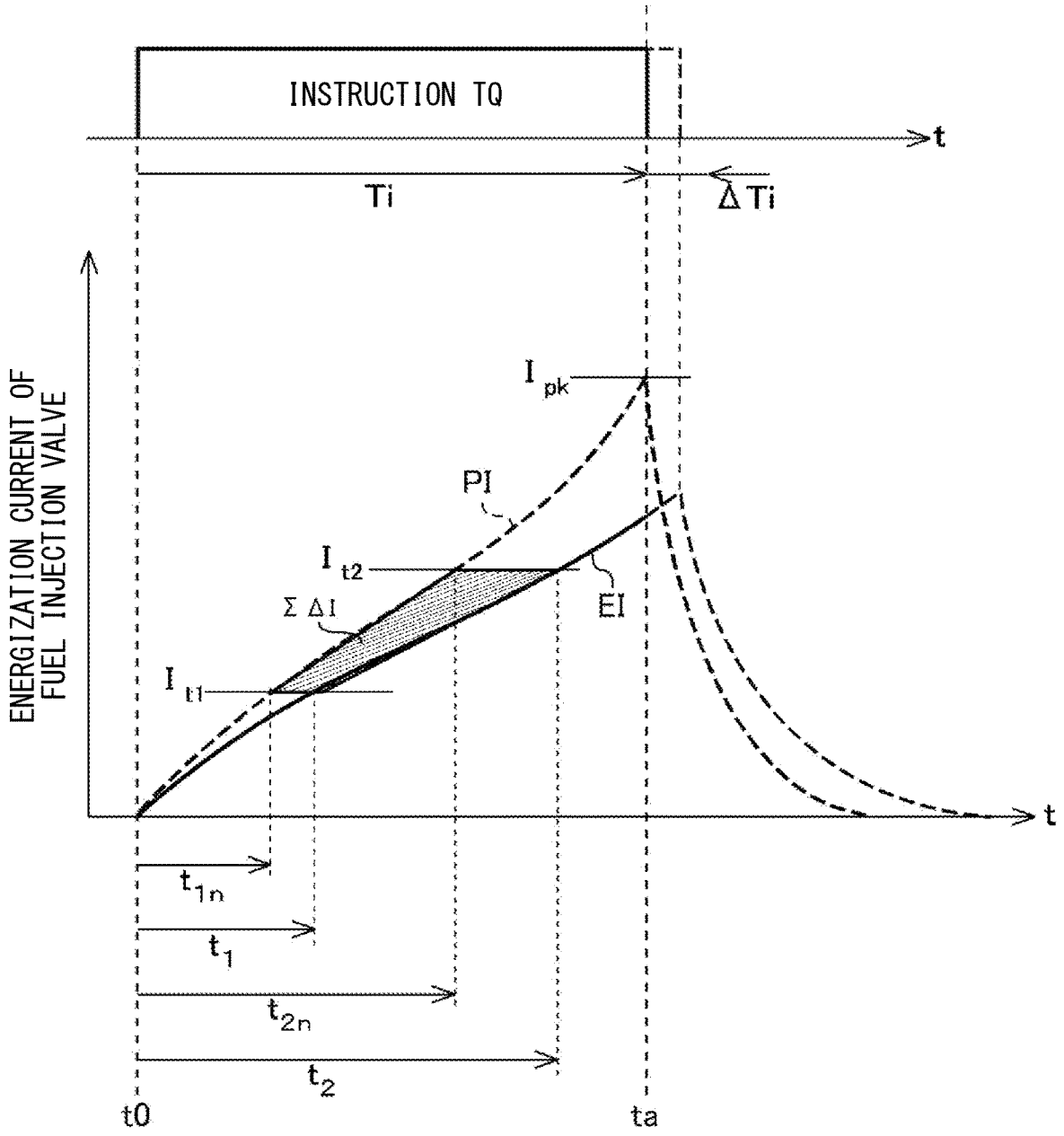
FIG. 3 is an explanatory diagram of a method of calculating an integrated current difference.

As shown in FIG. 3, the microcontroller 4 calculates the required injection amount by the energization instruction time calculator 10 at an on-timing t0 of when the energization instruction is given, and also calculates the energization instruction time Ti of the instruction TQ to energize the control IC 5, and outputs the calculation results to the energization controller 5*b*. In such manner, the microcontroller 4 instructions the control IC 5 with the energization instruction time Ti of the instruction TQ.

The control IC 5 stores a normal current profile PI which is a target current for energizing the fuel injection valve 2 in an internal memory, and, based on the normal current profile PI, the control IC 5 performs a peak current control that achieves a target peak current Ipk by an application of the boost voltage Vboost to the fuel injection valve 2 under control of the energization controller 5*b*.

The control IC 5 continues to apply the boost voltage Vboost to an inter-terminal position between the terminals of the fuel injection valve 2 until the target peak current Ipk indicated by the normal current profile PI is reached/achieved based on the energization instruction time Ti of the instruction TQ. The energization current EI of the fuel injection valve 2 thus steeply rises and opens the fuel injection valve 2. As shown in FIG. 3, the energization current EI of the fuel injection valve 2 changes non-linearly based on the structure of the fuel injection valve 2.

The energization time correction amount calculator 5*d* calculates an integrated current difference ΣLI between the normal current profile PI and an actual current EI that energizes the fuel injection valve 2. The integrated current difference ΣLI is a region/area substantially surrounded by non-linear current curves, and the calculation load tends to be large for detailed calculation. Therefore, as shown in FIG. 3 and an equation (1), an area size of a trapezoid having (t, I)=(t1*n*, It1), (t1, It1), (t2*n*, It2), (t2, It2) as vertices may be considered as an approximation of (or associated with) the integrated current difference ΣLI, for the ease of calculation.

(Equation 1)

$$\Sigma\Delta I=\{(t_1-t_{1n})+(t_2-t_{2n})\}\times(I_2-I_1)+2 \tag{1}$$

The energization time correction amount calculator 5*d* calculates the integrated current difference ΣLI between (i) the normal current profile PI from an ideal reach time tin reaching a current threshold value It1 to an ideal reach time t2*n* reaching a current threshold value It2, and (ii) the energization current EI of the fuel injection valve 2 from a reach time t1 actually reaching the current threshold value It1 to a reach time t2 actually reaching a current threshold value It2. In such manner, the energization time correction amount calculator 5*d* can easily calculate the integrated current difference ΣLI by detecting the reach times t1 and t2 at which the current threshold values It1 and It2 are reached.

Further, the energization time correction amount calculator 5*d* calculates a shortage energy Ei (i.e., an amount of insufficiency) by multiplying the integrated current difference ΣLI by the correction coefficient α input from the energization instruction time calculator 10 as shown in an equation (2).

(Equation 2)

$$Ei=\Sigma\Delta I\times\alpha=\{(t_1-t_{1n})+(t_2-t_{2n})\}\times(I_2-I_1)+2\times\alpha \tag{2}$$

Figure 4:
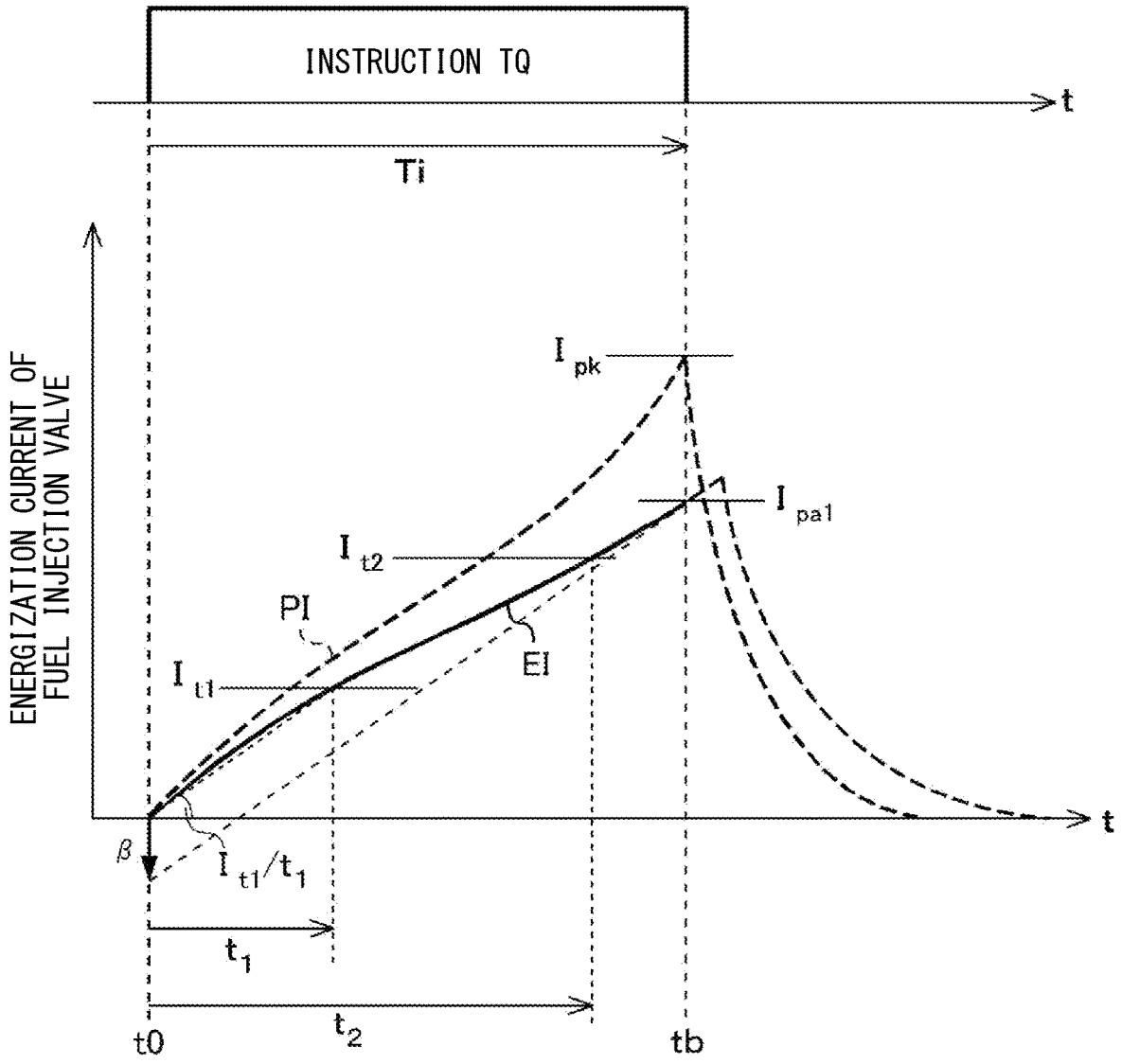
FIG. 4 is an explanatory diagram of a method of calculating a peak current estimated value.

As shown in FIG. 4, the energization time correction amount calculator 5*d* calculates a current gradient from the on-timing t0 of the injection instruction signal to an achieve time t1 at which the current threshold value It1 is achieved, adds the correction coefficient β as an intercept, and calculates the peak current estimated value Ipa1 at the time when the energization instruction time Ti indicated by the instruction TQ has elapsed. That is, the peak current estimated value Ipa1 may be calculated based on an equation (3).

(Equation 3)

$$I_{pa1}=\frac{I_{t1}}{t_1}\times Ti+\beta \tag{3}$$

The correction coefficient β indicates an offset term for accurately estimating the peak current estimated value Ipa1 at the time of application off timing. Further, in the above, the current gradient from the on-timing t0 of the injection instruction signal to the achieve time t1 to reach the current threshold value It1 is used as the first term of the equation (3). However, the current gradient from the on-timing t0 to an achieve time t2 at which the current threshold value It2 is achieved may also be used as the first term of the equation (3).

Next, the energization time correction amount calculator 5*d* calculates the energization time correction amount ΔTi for compensating for the shortage energy Ei. Specifically, as shown in an equation (4), the energization time correction amount calculator 5*d* calculates the energization time correction amount ΔTi by dividing the calculated shortage energy Ei by the peak current estimated value Ipa1.

(Equation 4)

$$\Delta Ti=Ei\div I_{pa1}=\frac{\{(t_1-t_{1n})+(t_2-t_{2n})\}\times(I_2-I_1)\times\left(\frac{1}{1024\times0.03}\right)\div2\times\alpha}{\frac{I_{t1}}{t_1}\left(\frac{1}{1024\times0.03}\right)Ti+\beta}=\frac{\{(t_1-t_{1n})+(t_2-t_{2n})\}\times(I_2-I_1)\times\left(\frac{1}{1024\times0.03}\right)\times\alpha2\times t_1}{\left\{I_{t1}\left(\frac{1}{1024\times0.03}\right)Ti\right\}+\beta\times t_1} \tag{4}$$

The denominator and numerator 1/(1024×0.03) in the equation (4) represent a gain for converting the A/D conversion value of a detection current I into a physical quantity. Further, α2=α/2. By deriving the energization time correction amount ΔTi using the equation (4), which depends on the insufficient energy Ei and the peak current estimated value Ipa1, an extension time to compensate for the insufficient energy Ei can be easily calculated with drastically reduced calculation amount.

When the energization time correction amount calculator 5*d* outputs the calculated energization time correction amount ΔTi to the energization controller 5*b*, the energization controller 5*b* corrects the energization instruction time Ti during a period before a timing tb when the detected current I detected by the current monitor 5*c* reaches the peak current estimated value Ipa1, by using the energization instruction time Ti of the instruction TQ+the energization time correction amount ΔTi as an effective energization instruction time of an instruction TQ. As a result, the energization instruction time Ti of the instruction TQ can be easily corrected, and the energization instruction time Ti can be extended. By using such a method, it is not necessary to adjust the energization instruction time Ti in advance in anticipation of variation in order to prevent misfire, and misfire countermeasures can be taken without deteriorating fuel efficiency as much as possible.

The energization time correction amount calculator 5*d* calculates the energization time correction amount ΔTi during a period between (i) the time when the current threshold value It2 is reached/achieved and (ii) the time when the peak current estimated value Ipa1 is reached/achieved. Therefore, the energization instruction time Ti can be corrected with a margin (i.e., well in advance/correction of Ti appropriately performable with sufficient calculation time). Although the example of calculating the energization time correction amount ΔTi based on the equations (1) to (4) is shown in the above, these equations show an example only and the correction method is not limited to such method.

<Description of Control>

Figure 5:
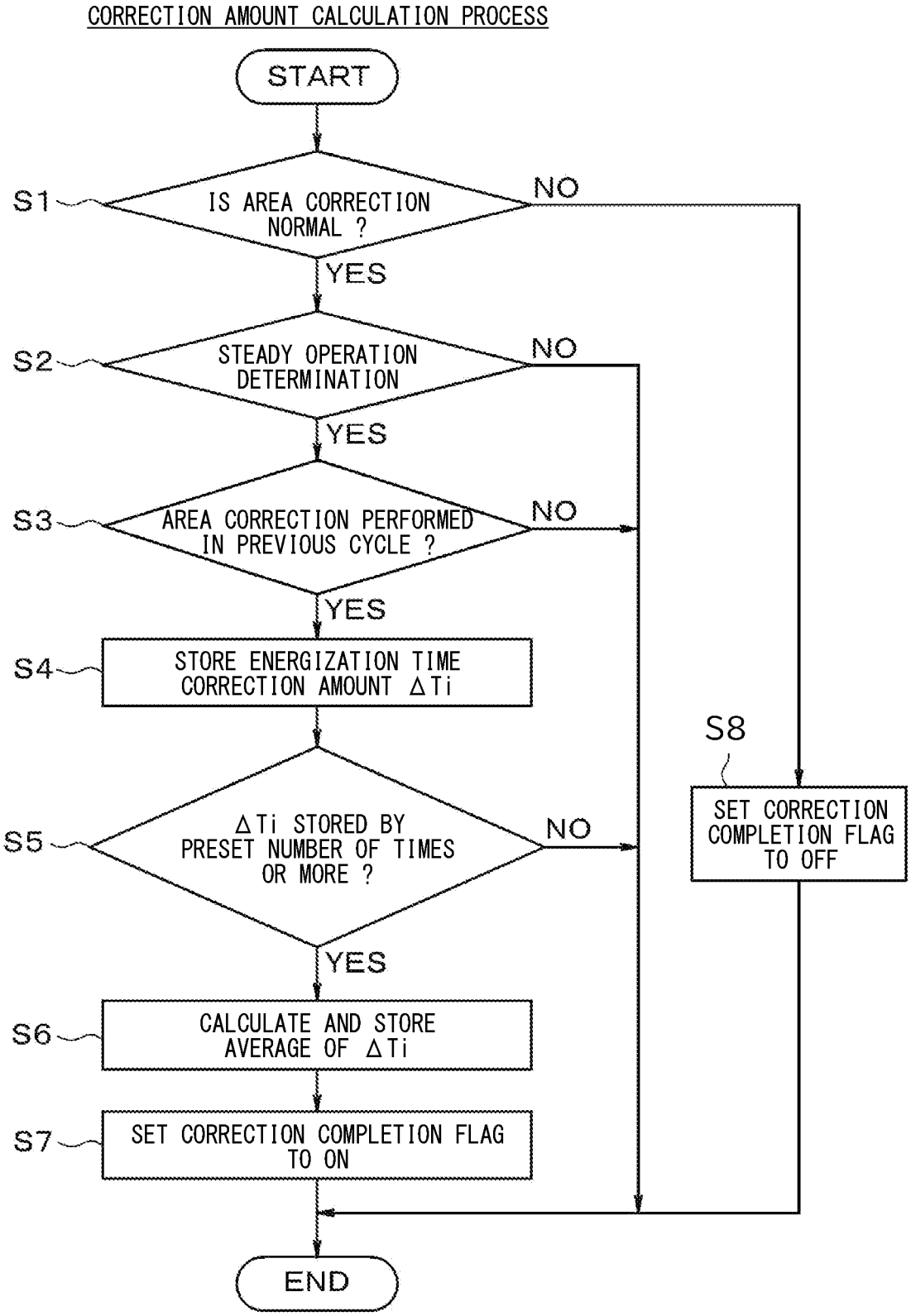
FIG. 5 is a flowchart schematically showing a flow of a correction amount calculation process.

FIG. 5 schematically shows the processing contents performed by the microcontroller 4. The microcontroller 4 determines, in S1, whether or not an area correction process is normally performed by determining whether or not the energization time correction amount ΔTi is normally calculated by the control IC 5. If the microcontroller 4 has an abnormality (specifically, an area correction abnormalilty) caused in the calculation process of the energization time correction amount ΔTi due to unknown influence and the energization time correction amount ΔTi has not been normally obtained by the control IC 5, a correction completion flag is set to OFF in S8 to cancel/interrupt the future area correction process by the control IC 5.

If the area correction is normally performed by the control IC 5, the microcontroller 4 detects a state of the internal combustion engine in S2, and determines whether or not it is in a steady operation state. During such determination, the microcontroller 4 determines whether the engine is in the steady operation state, based on a determination of whether the engine speed is within a preset steady range and/or whether the air intake amount satisfies a preset steady condition.

In particular, in a steady operation state such as a catalyst rapid warm-up operation, the energization time correction amount ΔTi tends to be set to the substantially same amount. Therefore, the microcontroller 4 may preferably determine whether or not the engine is in the steady operation state, by determining (A) whether conditions regarding periodically-performed injections (e.g., required injection amount, engine speed, air intake amount) are satisfied as being within a preset stable range, and (B) whether a condition is satisfied in terms of having the energization time correction amount ΔTi being within a preset range.

Next, if the microcontroller 4 determines in S2 that it is in a steady operation state, it determines YES in S2, and in S3, determines whether or not the control IC 5 has performed area correction in the previous injection. If the area correction has been performed in the previous injection, the microcontroller 4 determines YES in S3, and the correction amount calculator 11 of the microcontroller 4 inputs the energization time correction amount ΔTi from the energization time correction amount calculator 5*d*. If the control IC 5 determines that the area correction has not been performed, the microcontroller 4 determines NO in S3 and exits the routine.

The microcontroller 4 determines that the energization time correction amount ΔTi presently being input is the energization time correction amount ΔTi for the current cycle/injection, and stores the energization time correction amount ΔTi input in S4 in the memory 4*b*. The microcontroller 4 determines, in S5, whether or not the number of times of storing the energization time correction amount ΔTi for each of serial injections is equal to or greater than a preset number. When the microcontroller 4 determines YES in S5, the microcontroller 4 totals the current energization time correction amount ΔTi stored in the memory 4*b* by the processing of the correction amount calculator 11 with the past energization time correction amount(s) ΔTi, and divides the total value by the number of integrations, to calculate an average of the energization time correction amounts ΔTi of the current and previous cycles, and stores the average in the memory 4*b*. Then, in S7, the microcontroller 4 stores and retains the fact that the correction of the energization time is complete by setting the correction completion flag to ON. The correction amount calculator 11 outputs a conversion value (an average value in this example) of the energization time correction amount ΔTi to the energization instruction time calculator 10.

In the present embodiment, an example is shown that the average value of the energization time correction amount ΔTi for the preset number of times in and before the current cycle/injection is calculated for the output of the conversion value of the energization time correction amount ΔTi. However, the present disclosure is not limited to such a simple moving average. The weighting for each energization time correction amount ΔTi in and before the current cycle may be appropriately changed to obtain a weighted moving average as the conversion value.

Figure 6:
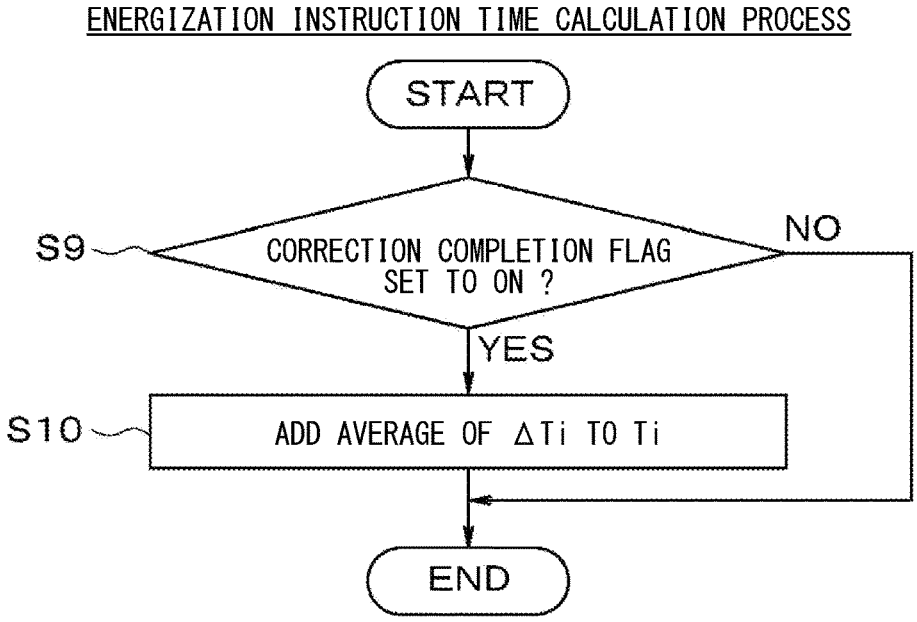
FIG. 6 is a flowchart schematically showing a flow of an energization instruction time calculation process.

The microcontroller 4 determines whether or not the correction completion flag is ON in S9 of FIG. 6, and, the energization instruction time calculator 10 receives, on the condition of YES determination in S9, an input of the conversion value of the energization time correction amount ΔTi calculated by the correction amount calculator 11, and the energization instruction time calculator 10 calculates, in S10, the energization instruction time Ti of the next instruction TQ by adding the conversion value thereto.

Note that the correction completion flag is initially OFF (i.e., it is set to OFF when a power supply to ECU 1 is turned ON), and the previous state is set (either OFF or ON) in the second cycle of processing and thereafter.

On the other hand, the microcontroller 4 obtains the A/F value by a timer interrupt of every few ms asynchronously with the above-mentioned injection timing. Since the microcontroller 4 obtains the A/F value asynchronously with the injection timing, the microcontroller 4 may obtain the A/F value from the A/F sensor 9 while injecting fuel from the fuel injection valve 2, or, may obtain the A/F value after injecting fuel. When the above-mentioned correction completion flag is being set to ON, the microcontroller 4 can obtain, from the A/F value obtainer 12, an A/F value corresponding to the injection reflecting the energization time correction amount ΔTi of the energization instruction time calculator 10.

Figure 7:
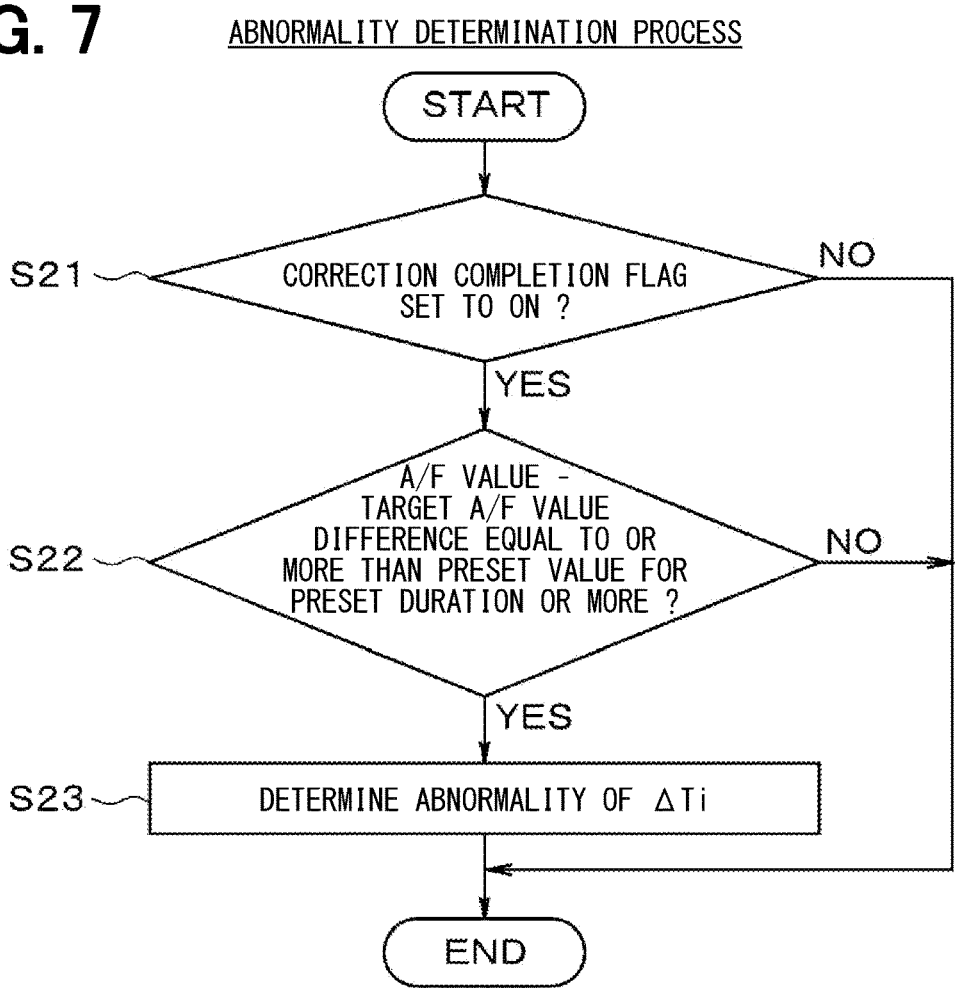
FIG. 7 is a flowchart schematically showing a flow of an abnormality determination process.

The microcontroller 4 detects, in S22, whether a difference between the obtained A/F value and the target A/F value, provided that the above-mentioned correction completion flag is being set to ON in S21 of FIG. 7, and determines whether the preset time or more has elapsed with the above difference or more by the abnormality determiner 13.

When the determination result of S22 is YES, the microcontroller 4 determines that the energization time correction amount ΔTi is abnormal. That is, even if the A/F value obtained from the A/F sensor 9 elapses for a preset time or more in the steady operation state, when a state diverted from the target A/F value by a preset time or more is continuing, the microcontroller 4 determines that the energization time correction amount ΔTi is suffering from a correction abnormality.

When the microcontroller 4 determines that the energization time correction amount ΔTi suffers from an area correction abnormality (such as the area correction abnormality in S1=NO), it determines that the area correction is not normal in step S1 of the correction amount calculation process of FIG. 5, and sets the correction completion flag to OFF. When the microcontroller 4 determines that the area correction is not normal, the correction completion flag is set to OFF, and the subsequent correction process of the energization time correction amount ΔTi is stopped/cancelled. See NO in S1 of FIG. 5, NO in S9 of FIG. 6, and NO in S21 of FIG. 7.

That is, when the microcontroller 4 determines that the area correction abnormality (S1=NO) of the energization time correction amount ΔTi is caused, it determines that an intended injection is not performable even if the area correction is performed using such an energization time correction amount ΔTi, and thereafter stops the calculation/correction process of the energization time correction amount ΔTi. In such manner, a fail-safe operation is realized.

In FIG. 7, step S22, the microcontroller 4 determines the A/F value correction abnormality of the energization time correction amount ΔTi using the A/F value of the A/F sensor 9 after reflecting the energization time correction amount ΔTi in and before current cycle/injection in/to the energization instruction time Ti of the next instruction TQ. In such manner, the A/F value correction abnormality of the energization time correction amount ΔTi can be determined as accurately as possible.

In particular, in a steady operation state such as rapid catalyst warm-up or the like, the energization time correction amount ΔTi is almost/substantially the same value, thereby the energization time correction amount ΔTi at the time of injection in or before the current cycle/injection reflected in the energization instruction time Ti of the next injection makes the energization time correction amount ΔTi in the subsequent cycles by the control IC 5 reducible, and secures/guarantees the S/N at the time of abnormality determination.

Summary of the Present Embodiment

According to the present embodiment, since the energization instruction time calculator 10 calculates the energization instruction time Ti of the next instruction TQ using the energization time correction amount ΔTi in and before the current cycle, the tendency/trend of the energization time correction amount ΔTi in and before the current cycle is reflected in the energization instruction time Ti of the next instruction TO.

Therefore, when the microcontroller 4 instructs the energization controller 5*b* with the energization instruction time Ti of the next instruction TQ and the energization controller 5*b* of the control IC 5 performs the energization control of the fuel injection valve 2, the control IC 5 is enabled to correct the energization time by near-zero value, i.e., the energization time correction amount ΔTi calculated by the calculation unit 5*d* can be set to zero or a small/nominal value, and the S/N of the energization time correction amount ΔTi is securable/guaranteeable. Therefore, even if the resolution of the A/D converter implemented in the control IC 5 is poor/low and the obtainable S/N of the detected current I is not sufficiently high, the energization time correction amount ΔTi can appropriately be calculable.

Further, in the microcontroller 4, the A/F value obtainer 12 obtains the A/F value corresponding to the injection reflecting the correction of the energization time correction amount ΔTi by the energization instruction time calculator 10, and the abnormality determination is performable by the abnormality determiner 13, based on the deviation/difference of the A/F value from the target A/F value. Thereby, it can be determined whether or not the energization time correction amount ΔTi is an abnormal value. Further, when an abnormality occurs in the energization time correction amount ΔTi, the microcontroller 4 stops the correction processing of the energization time correction amount ΔTi, so that the fail-safe processing can appropriately be performable.

Other Embodiments

The present disclosure should not be limited to the embodiments described above, and various modifications may further be implemented without departing from the gist of the present disclosure. For example, the following modifications or extensions are possible. The multiple embodiments described above may be combined as necessary.

Though an example in the above shows that the microcontroller 4 uses the energization time correction amount ΔTi in and before the current cycle to correct the next energization instruction time Ti, the energization instruction time Ti of the injection after the next cycle, that is, in a cycle or cycles after the next cycle may also be corrected in the above-described manner. Although the embodiment in which the microcontroller 4 and the control IC 5 are configured by separate integrated circuits has been described, they may be integrally configured in one body as an integrated circuit. In case of having one body configuration, it may be preferable to use an arithmetic processor or the like with high-speed processing capacity.

In the above-described embodiment, the control IC 5 approximates the integrated current difference ΣLI by calculating the trapezoidal area of the energization current EI of the fuel injection valve 2. However, the present disclosure is not limited to such scheme. The energization current EI of the fuel injection valve 2 changes non-linearly before reaching the target peak current Ipk and after reaching the target peak current Ipk. Therefore, it may be preferable to use approximation of a polygon such as a triangle, a rectangle, or a trapezoid, for the calculation of the integrated current difference. In such manner, the amount of calculation can be drastically reducible.

In the above-described embodiment, the present disclosure is applied to an in-cylinder injection that injects fuel directly into a combustion chamber of an internal combustion engine. However, the present disclosure is not limited to such scheme, i.e., is applicable to a well-known port injection that injects fuel into a part in front of an intake valve.

The means and/or functions provided by the microcontroller 4 and the control IC 5 can be provided by software recorded in a substantive memory device and a computer that executes the software, or by software, or by hardware, or by a combination thereof. For example, when a control device is provided by an electronic circuit that is hardware, it can be configured by a digital circuit or an analog circuit including one or more logic circuits. Further, for example, when the control device executes various controls by software, a program is stored in a storage unit, and a control entity executing the program implements a method corresponding to the program.

Embodiments described above may be combined to implement the control of the present disclosure. In addition, the reference numerals in parentheses described in the claims simply indicate correspondence to the concrete means described in the embodiments, which is an example of the present disclosure. That is, the technical scope of the present disclosure is not necessarily limited thereto. A part of the above-described embodiment may be dispensed/dropped as long as the problem identified in the background is resolvable. In addition, various modifications from the present disclosure in the claims are considered also as an embodiment thereof as long as such modification pertains to the gist of the present disclosure.

Although the present disclosure has been described in accordance with the above-described embodiments, it is understood that the present disclosure is not limited to the embodiments and structures. The present disclosure encompasses various modifications and variations within the scope of equivalents. In addition, various modes/combinations, one or more elements added/subtracted thereto/therefrom, may also be considered as the present disclosure and understood as the technical thought thereof.

What is claimed is:

1. An injection control device comprising:

an area corrector calculating an energization time correction amount by performing area correction of electric current flowing through a fuel injection valve when the fuel injection valve is driven by electric current to inject fuel from the fuel injection valve;

an energization instruction time calculator correcting an energization instruction time of a next injection based on:

(i) a present energization time correction amount and (ii) previous energization time correction amounts;

an air-fuel ratio (A/F) value obtainer capable of obtaining an A/F value using an A/F sensor; and an abnormality determiner determining abnormality based on a deviation of an obtained A/F value from a target A/F value, the obtained A/F value obtained by the A/F value obtainer which corresponds to the injection reflecting a correction with the energization time correction amount by the energization instruction time calculator.

2. A device comprising:

a processor; and a non-transitory computer-readable storage medium, wherein the device is configured to:

calculate a first area correction associated with a difference between an integrated ideal current profile and an integrated actual current profile for a first injection;

determine that the first area correction is normal;

determine that a steady operation is present;

determine that a previous area correction was performed in a previous cycle;

store a first energization time correction amount associated with the first injection;

determine that energization time correction amounts have been stored a preset number of times;

calculate and store an average energization time correction amount; and set a correction completion flag to ON.

3. The device of claim 2, wherein the device is further configured to:

determine that the correction completion flag is set to ON; and add the average energization time correction amount to an instruction time to generate a corrected instruction time for the first injection.

4. The device of claim 3, wherein the device is further configured to:

determine that the correction completion flag is set to ON;

determine a difference of (i) a sensed A/F value and (ii) a target A/F value;

determine that the difference is not more than a preset value for a preset duration; and use the corrected instruction time to control the first injection.

* * * * *